US009732975B2

(12) United States Patent
Maeda et al.

(10) Patent No.: US 9,732,975 B2
(45) Date of Patent: Aug. 15, 2017

(54) AIR-CONDITIONING SYSTEM

(75) Inventors: Kazuo Maeda, Chiyoda-ku (JP); Toshihiro Ishikawa, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 787 days.

(21) Appl. No.: 13/574,951

(22) PCT Filed: Feb. 17, 2010

(86) PCT No.: PCT/JP2010/000982
§ 371 (c)(1),
(2), (4) Date: Jul. 24, 2012

(87) PCT Pub. No.: WO2011/101892
PCT Pub. Date: Aug. 25, 2011

(65) Prior Publication Data
US 2012/0298347 A1 Nov. 29, 2012

(51) Int. Cl.
*F25B 9/00* (2006.01)
*F24F 11/00* (2006.01)

(52) U.S. Cl.
CPC ..... *F24F 11/006* (2013.01); *F24F 2011/0063* (2013.01); *F24F 2011/0067* (2013.01); *F24F 2011/0075* (2013.01); *F24F 2221/54* (2013.01)

(58) Field of Classification Search
CPC ..... F25B 29/00; F24F 2011/0075; F24F 2221/54; F24F 2011/0063; F24F 11/006; F24F 2011/0067
(Continued)

(56) References Cited

U.S. PATENT DOCUMENTS 6,296,193 B1 * 10/2001 West ..... F24F 3/044 236/1 B
7,031,880 B1 * 4/2006 Seem et al. ..... 702/182
2004/0138784 A1 7/2004 Park et al.
2007/0137225 A1 * 6/2007 Shindo ..... F24F 3/065 62/160
2009/0138127 A1 * 5/2009 Sangenya et al. ..... 700/280
(Continued)

FOREIGN PATENT DOCUMENTS

CN 1517625 A 8/2004
CN 101464026 A 6/2009
(Continued)

OTHER PUBLICATIONS

International Search Report (PCT/ISA/210) issued on May 25, 2010, by the Japanese Patent Office as the International Searching Authority for International Application No. PCT/JP2010/000982.
(Continued)

*Primary Examiner* — Charles Kasenge
(74) *Attorney, Agent, or Firm* — Buchanan Ingersoll & Rooney PC

(57) ABSTRACT

There is provided an air-conditioning system in which at least one or some of a plurality of air-conditioning apparatuses are each controllable such that the indoor temperature is maintained between two set temperatures. All the plurality of air-conditioning apparatuses are switched to either one of heating operation and cooling operation on the basis of a temperature difference between the indoor temperature related to an air-conditioning apparatus that is in the first operation mode and a set target temperature and a temperature difference between the indoor temperature related to an air-conditioning apparatuses that is in the second operation mode and an upper temperature limit or a lower temperature limit.

10 Claims, 5 Drawing Sheets

(58) Field of Classification Search
USPC ..... 165/201
See application file for complete search history.

(56) References Cited

U.S. PATENT DOCUMENTS

| | | | | |
|---|---|---|---|---|
| 2009/0157529 | A1* | 6/2009 | Ehlers | F24F 11/0012 705/26.1 |
| 2009/0158759 | A1 | 6/2009 | Seo et al. | |
| 2009/0266903 | A1* | 10/2009 | Fitzgerald | F24F 13/105 236/49.3 |

FOREIGN PATENT DOCUMENTS

| | | | |
|---|---|---|---|
| EP | 1 437 558 | A | 7/2004 |
| EP | 1643195 | A2 * | 4/2006 |
| EP | 2 072 922 | A1 | 6/2009 |
| JP | 1-260252 | A | 10/1989 |
| JP | 2001-235217 | A | 8/2001 |
| JP | 2005-180770 | A | 7/2005 |
| KR | 10-0795602 | B1 | 1/2008 |

OTHER PUBLICATIONS

Office Action dated May 20, 2014, issued in corresponding Chinese Patent Application No. 201080064096.8, and English language translation of Office Action. (19 pages).
Office Action (Second Office Action) issued on Dec. 31, 2014, by the Chinese Patent Office in corresponding Chinese Patent Application No. 201080064096.8, and an English Translation of the Office Action. (21 pages).

* cited by examiner

FIG. 3

| | | |
|---|---|---|
| TARGET SET TEMPERATURE +3.0°C | + 2 | THERMO - ON |
| TARGET SET TEMPERATURE +1.5°C | + 1 | |
| TARGET SET TEMPERATURE | 0 | THERMO - OFF |
| TARGET SET TEMPERATURE -1.5°C | - 1 | THERMO - ON |
| TARGET SET TEMPERATURE -3.0°C | - 2 | |

(a): FIRST SCORE TABLE

| | | |
|---|---|---|
| 32.5°C (FIXED VALUE) | + 4 | THERMO - ON |
| UPPER-LIMIT SET TEMPERATURE +3.0°C | + 2 | |
| UPPER-LIMIT SET TEMPERATURE +1.5°C | + 1 | |
| UPPER-LIMIT SET TEMPERATURE | 0 | THERMO - OFF |
| LOWER-LIMIT SET TEMPERATURE | | |
| LOWER-LIMIT SET TEMPERATURE -1.5°C | - 1 | THERMO - ON |
| LOWER-LIMIT SET TEMPERATURE -3.0°C | - 2 | |
| 13.0°C (FIXED VALUE) | - 4 | |

(b): SECOND SCORE TABLE

F I G. 7
(a)
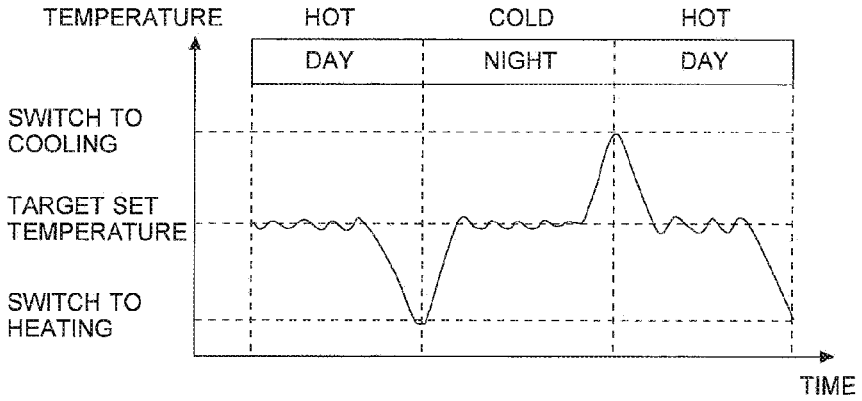
(b)
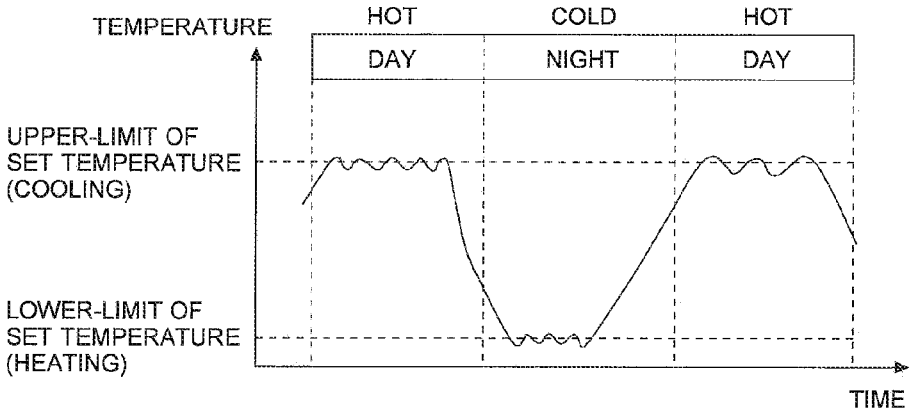

AIR-CONDITIONING SYSTEM

TECHNICAL FIELD

The present invention relates to an air-conditioning system in which all of a plurality of air-conditioning apparatuses are switched to either one of heating operation and cooling operation.

BACKGROUND ART

In the known art, there has been proposed "an automatic cooling/heating switching system included in an air-conditioning system in which a certain outdoor unit is connected to a plurality of indoor units with one refrigerant piping system, the automatic cooling/heating switching system comprising a temperature control means that detects and controls ambient temperatures of each of the indoor units, a controlling means that determines an operation mode of the air-conditioning system by integrating each operating state of the indoor units each defined in correspondence with a difference between the ambient temperature related to the indoor unit and set temperature related to the indoor unit, and an operation mode switching means that switches all the indoor units to cooling or heating operation at a time on the basis of the determination" (see Patent Literature 1, for example).

CITATION LIST

Patent Literature

Patent Literature 1: Japanese Unexamined Patent Application Publication No. 2005-180770 (Claim 1)

SUMMARY OF INVENTION

Technical Problem

In the air-conditioning system disclosed in Patent Literature 1, all of a plurality of air-conditioning apparatuses are switched to either one of heating operation and cooling operation.

In such an air-conditioning system, each of the set temperatures related to the plurality of air-conditioning apparatuses are compared with the corresponding indoor temperature. If there are more air-conditioning apparatuses that is required to perform heating operation than air-conditioning apparatuses that is required to perform cooling operation, all the plurality of air-conditioning apparatuses are switched to heating operation. If there are more air-conditioning apparatuses that is required to perform cooling operation than air-conditioning apparatuses that is required to perform heating operation, all the plurality of air-conditioning apparatuses are switched to cooling operation.

Furthermore, the operating state of each of the air-conditioning apparatuses is controlled such that the indoor temperature become close to the set temperature.

In such a control method, even if the plurality of air-conditioning apparatuses each do not have a function of individually switching between cooling and heating, the system as a whole can be controlled such that the indoor temperatures become close to the set temperatures. Thus, comfort in indoor spaces can be improved.

For example, in a case in which the air-conditioning system is installed in a region where there is a large temperature difference in one day, during daytime when the temperature is high, the system as a whole is switched to cooling operation, thereby the indoor temperatures can be controlled to become close to the set temperatures. Whereas, during night time when the temperature is low, the system as a whole is switched to heating operation, thereby the indoor temperatures can be controlled to become close to the set temperatures.

However, with an aim to improve energy savings, when, for example, the system as a whole is switched to heating operation after the set temperatures related to one or some of the air-conditioning apparatuses are raised during cooling operation, excessive heating operation is performed in order to bring the indoor temperatures close to the set temperatures.

Meanwhile, when, for example, the system as a whole is switched to cooling operation after the set temperatures related to one or some of the air-conditioning apparatuses are lowered during heating operation, excessive cooling operation is performed in order to bring the indoor temperatures close to the set temperatures.

Accordingly, there is a problem in that improvement of energy-saving cannot be achieved.

There is another conventional air-conditioning system in which a plurality of air-conditioning apparatuses are individually switchable between heating operation and cooling operation.

In such an air-conditioning system, an upper limit of temperature and a lower limit of temperature are set. When an indoor temperature exceeds the upper limit of temperature, the corresponding air-conditioning apparatus is switched to cooling operation and is controlled such that the indoor temperature do not exceed the upper limit of temperature. When an indoor temperature fall below the lower limit of temperature, the corresponding air-conditioning apparatus is switched to heating operation and is controlled such that the indoor temperature do not fall below the lower limit of temperature. (This will be hereinafter referred to as a "setback control method".)

According to the setback control method, in a case where a plurality of air-conditioning apparatuses each have a function of individually switching between cooling and heating, the indoor temperatures can be controlled to be between two set temperatures, that is, the upper limit of temperature and the lower limit of temperature. Furthermore, by setting the temperature difference between the upper limit of temperature and the lower limit of temperature large, the time period of thermo-OFF of the air-conditioning apparatuses can be increased. Consequently, energy saving can be improved.

For example, in a case where the air-conditioning system is installed in a region where there is a large temperature difference in one day, while energy is saved by raising the upper limit of temperature, the indoor temperatures can be controlled not to fall below the lower limit of temperature during night time when the temperature is low.

However, in the air-conditioning system in which all of a plurality of air-conditioning apparatuses are switched to either one of heating operation and cooling operation, the air-conditioning apparatuses cannot be individually switched between cooling and heating. Accordingly, there is a problem in that the above setback control method cannot be employed.

The present invention has been made to solve the above problems and provides an air-conditioning system in which all of a plurality of air-conditioning apparatuses are switched to either one of heating operation and cooling operation and in which at least one or some of the plurality of air-conditioning apparatuses are controllable such that the indoor temperatures are maintained between two set temperatures.

The invention also provides an air-conditioning system in which, while at least one or some of a plurality of air-conditioning apparatuses are controlled such that the indoor temperatures are maintained between two set temperatures, the system as a whole is switchable between cooling operation and heating operation on the basis of the difference between the indoor temperature related to each air-conditioning apparatus and the set temperature.

The invention also provides an air-conditioning system in which one or some of a plurality of air-conditioning apparatuses are controllable such that the indoor temperatures become close to a single set temperature while the remaining one or some are controllable such that the indoor temperatures are maintained between the two set temperatures, thus achieving both comfortability and energy saving.

Solution to Problem

An air-conditioning system according to the invention includes a plurality of air-conditioning apparatuses; and a controller that switches all the air-conditioning apparatuses to either one of heating operation and cooling operation, wherein each air-conditioning apparatus is operable in a first operation mode that sets a first set temperature and that controls a corresponding air-conditioning apparatus such that an indoor temperature of a space where the corresponding air-conditioning apparatus is provided becomes the first set temperature, and a second operation mode that sets a second set temperature and a third set temperature, which is lower than the second set temperature, and that controls a corresponding air-conditioning apparatus such that, during cooling operation, an indoor temperature of a space where the corresponding air-conditioning apparatus is provided becomes below the second set temperature and, during heating operation, the indoor temperature of the space where the corresponding air-conditioning apparatus is provided becomes above the third set temperature, and the controller switches all the air-conditioning apparatuses to either one of heating operation and cooling operation on the basis of a temperature difference between the indoor temperature related to each air-conditioning apparatus that is in the first operation mode and the first set temperature and a temperature difference between the indoor temperature related to each air-conditioning apparatus that is in the second operation mode and the second set temperature or the third set temperature.

Advantageous Effects of Invention

According to the invention, all the plurality of air-conditioning apparatuses are switched to either one of heating operation and cooling operation on the basis of the difference between the indoor temperature related to each air-conditioning apparatus that is in the first operation mode and the first set temperature and the difference between the indoor temperature related to each air-conditioning apparatus that is in the second operation mode and the second set temperature or the third set temperature.

Thus, in the air-conditioning system in which all of a plurality of air-conditioning apparatuses are switched to either one of heating operation and cooling operation, the indoor temperatures related to at least one or some of the plurality of air-conditioning apparatuses can be controlled to be between the second set temperature and the third set temperature.

BRIEF DESCRIPTION OF DRAWINGS

FIG. 3 includes diagrams illustrating data configurations of score tables according to Embodiment 1.

FIG. 7 includes graphs illustrating exemplary temperature changes in a first operation mode and a second operation mode, according to Embodiment 1.

DESCRIPTION OF EMBODIMENTS

Embodiment 1

Figure 1:
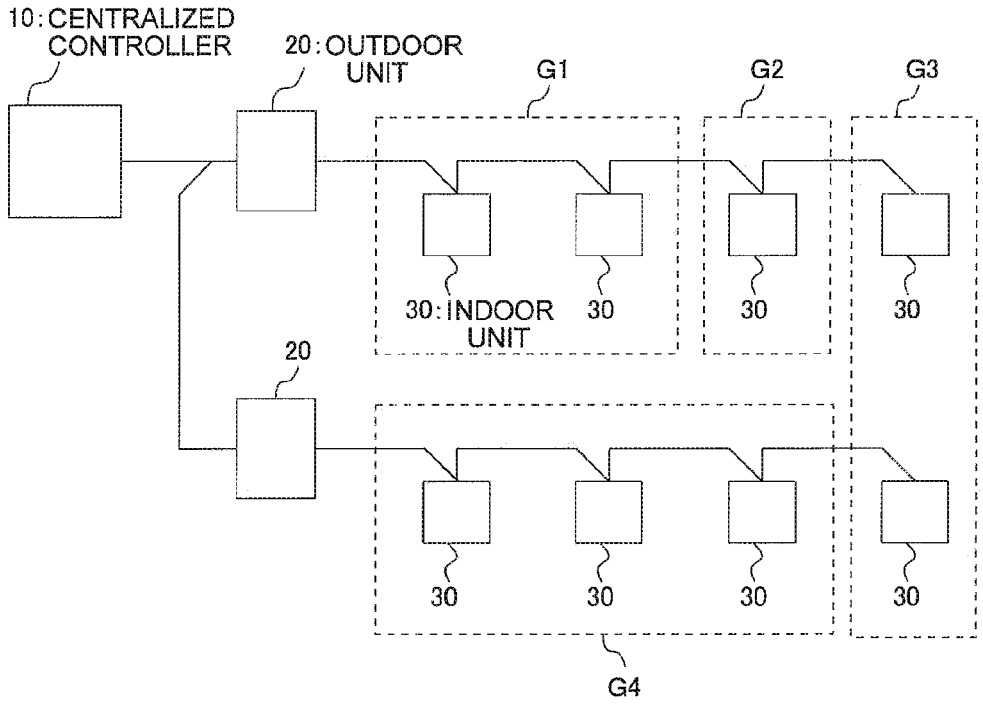
FIG. 1 is a block diagram illustrating a configuration of an air-conditioning system according to Embodiment 1.

FIG. 1 is a block diagram illustrating a configuration of an air-conditioning system according to Embodiment 1.

Referring to FIG. 1, the air-conditioning system according to Embodiment 1 includes an integrated controller 10, an outdoor unit 20, and an indoor unit 30.

The indoor unit 30 is provided in a conditioned space (hereinafter also referred to as "indoor space") in plural number.

The outdoor unit 20 is provided in a space other than the conditioned space (hereinafter also referred to as "outdoor space") in either single or plural number.

The indoor units 30 are grouped in units of one or more indoor units 30. For example, indoor units 30 that are provided in a certain indoor space form one group. In the example illustrated in FIG. 1, four groups G1 to G4 are formed.

Each of the indoor units 30 operate in a first operation mode or a second operation mode in each group. Details of the operation will be described separately below.

The outdoor unit 20 and the indoor unit 30 correspond to "air-conditioning apparatus" according to the invention.

Hereinafter, the outdoor unit 20 and the indoor unit 30 may be collectively referred to as "air-conditioning apparatus".

The integrated controller 10 is connected to the outdoor units 20 and the indoor units 30 through communication lines.

The integrated controller 10 integrally controls operations of the outdoor units 20 and the indoor units 30.

The outdoor units 20 and the indoor units 30 are connected to each other with refrigerant pipes, and air conditioning is performed by changing the pressure of a refrigerant that flows through the pipes so that the refrigerant receives and transfers heat.

The outdoor units 20 each include a compressor, a heat exchanger on the outdoor unit side, a fan on the outdoor unit side, an expansion valve on the outdoor unit side, a four-way switching valves, and so forth, which are not illustrated.

The outdoor unit 20 controls operations performed by the elements included in the outdoor unit 20 on the basis of signals and the like transmitted from the integrated controller 10 and so forth.

The compressor compresses the refrigerant that is sucked therein and discharges the refrigerant after adding a certain amount of pressure thereto.

The heat exchanger on the outdoor unit side exchanges heat between the refrigerant flowing through the heat exchanger and air.

The fan on the outdoor unit side sends air used for heat exchange to the heat exchanger.

The four-way switching valve switches the flow path in accordance with the operation, such as a cooling operation or a heating operation.

The expansion valve adjusts its opening degree and thus controls the flow rate of the refrigerant.

The indoor units 30 each include a heat exchanger on the indoor unit side, a fan on the indoor unit side, an expansion valve on the indoor unit side, an indoor temperature sensor, and so forth, which are not illustrated.

The indoor unit 30 controls operations performed by the elements included in the indoor unit 30 on the basis of signals and the like transmitted from the integrated controller 10 and so forth.

The heat exchanger on the indoor unit side exchanges heat between the refrigerant flowing through the heat exchanger and air.

The fan on the indoor unit side sends air to the heat exchanger and causes the heat exchanger to exchange heat, and sends the air resulting from the heat exchange into the indoor space.

The expansion valve on the indoor unit side adjusts its opening degree and thus controls the flow rate of the refrigerant, thereby the expansion valve controls the amount of refrigerant that flows through the heat exchanger on the indoor unit side and thus adjusts the evaporation and so forth of the refrigerant in the heat exchanger on the indoor unit side.

The indoor temperature sensor detects the indoor temperature of the space where the indoor unit 30 is provided, and transmits information on the indoor temperature to the integrated controller 10.

In the air-conditioning system according to Embodiment 1, all the plurality of air-conditioning apparatuses are switched to either one of heating operation and cooling operation under the control of the integrated controller 10.

Note that in Embodiment 1, a state where heat is exchanged by circulating the refrigerant through the heat exchanger on the indoor side included in the indoor unit 30 is referred to as thermo-ON, and a state where the circulation of the refrigerant is stopped so that heat is not exchanged is referred to as thermo-OFF, for example.

The configuration of the integrated controller 10 will now be described.

Figure 2:
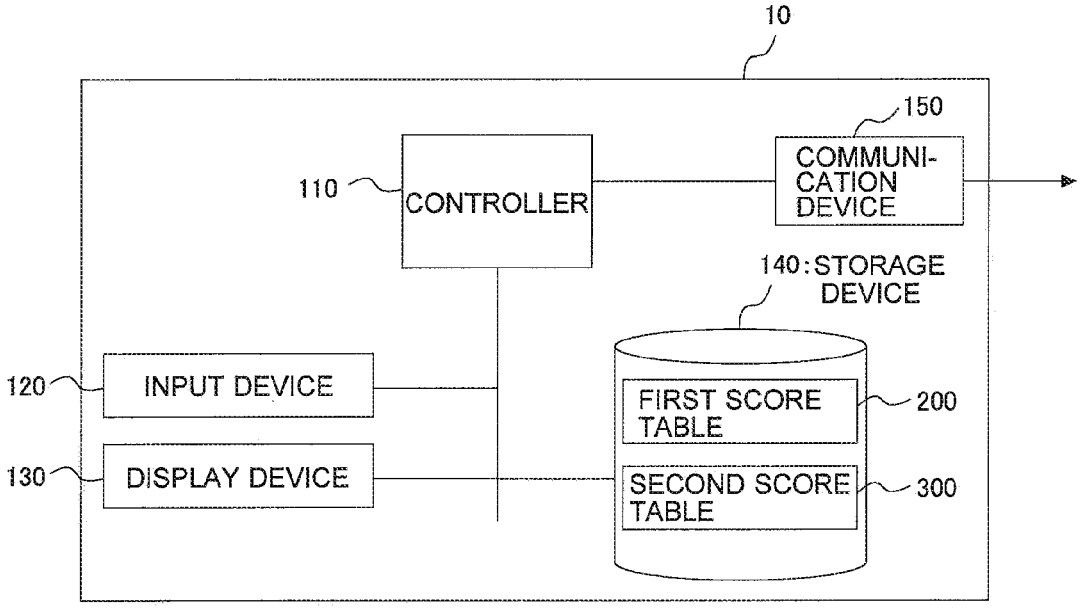
FIG. 2 is a diagram illustrating a configuration of an integrated controller 10 according to Embodiment 1.

FIG. 2 is a diagram illustrating the configuration of the integrated controller 10 according to Embodiment 1.

As illustrated in FIG. 2, the integrated controller 10 includes a controller 110, an input device 120, a display device 130, a storage device 140, and a communication device 150.

The controller 110 controls each air-conditioning apparatus on the basis of pieces of information such as the indoor temperature and the operation mode that are transmitted from each air-conditioning apparatus to the communication device 150. The controller 110 also switches all the plurality of air-conditioning apparatuses to either one of heating operation and cooling operation. Details will be described separately below.

The input device 120 is an interface through which the user inputs an operation mode, temperature settings, and so forth of the air-conditioning apparatuses. The input device 120 is also an interface through which information on score tables stored in the storage device 140, which will be described separately below, is input.

The display device 130 displays various menu windows, input operation windows, and the like in accordance with instructions issued from the controller 110.

The storage device 140 is pre-stored with a first score table 200 and a second score table 300. Details will be described separately below.

The first score table 200 corresponds to "first data table" according to the invention.

The second score table 300 corresponds to "second data table" according to the invention.

Note that the controller 110 may be constructed as hardware, such as a circuit device, that can implement the functions, or may be constructed as software, such as a microprocessor or a CPU, that is executed on an arithmetic device.

The input device 120 may be a touch panel, a keyboard, a mouse, or the like.

The display device 130 may be any device such as an LCD (liquid crystal display).

The storage device 140 may be any storage medium such as an HDD (hard disk drive) or a flash memory.

The communication device 150 may be any network interface such as a LAN interface.

Although Embodiment 1 describes a case where the integrated controller 10 includes the controller 110 and the storage device 140, the invention is not limited to such a case. The controller 110 and the storage device 140 may be included in the outdoor units 20 or the indoor units 30. Alternatively, a remote controller may be provided for each of the indoor units 30, and the controller 110 and the storage device 140 may be provided in the remote controller.

The configuration of the integrated controller 10 according to Embodiment 1 has been described above.

Now, the first score table 200 and the second score table 300 stored in the storage device 140 will be described.

FIG. 3 includes diagrams illustrating data configurations of the score tables according to Embodiment 1.

FIG. 3(*a*) illustrates the data configuration of the first score table 200.

FIG. 3(*b*) illustrates the data configuration of the second score table 300.

As illustrated in FIG. 3(*a*), the first score table 200 is set with information on the difference between a set target temperature and the indoor temperature and information on scores corresponding to the temperature difference.

The set target temperature is a temperature set as a target value of the indoor temperature in the first operation mode, which will be described separately below.

The set target temperature corresponds to "first set temperature" according to the invention.

As illustrated in FIG. 3(*a*), exemplary scores according to Embodiment 1 are as follows. A difference between the set target temperature and the indoor temperature of plus 1.5 degrees C. to plus 3.0 degrees C. has a score of plus 1.

A difference between the set target temperature and the indoor temperature greater than or equal to plus 3.0 degrees C. has a score of plus 2.

A difference between the set target temperature and the indoor temperature of minus 1.5 degrees C. to minus 3.0 degrees C. has a score of minus 1.

A difference between the set target temperature and the indoor temperature greater than or equal to minus 3.0 degrees C. has a score of minus 2.

The plus scores each correspond to "score associated to cooling" according to the invention.

The minus scores each correspond to "score associated to heating" according to the invention.

The first score table 200 is also set with information on the operating state of the air-conditioning apparatus corresponding to the information on the temperature difference.

For example, if the difference between the set target temperature and the indoor temperature falls within a range from minus 1.5 degrees C. to plus 1.5 degrees C., the mode is set to thermo-OFF.

If the difference between the set target temperature and the indoor temperature is greater than minus 1.5 degrees C. or plus 1.5 degrees C., the mode is set to thermo-ON.

As illustrated in FIG. 3(*b*), the second score table 300 is set with information on the difference between an upper temperature limit and the indoor temperature and the difference between a lower temperature limit and the indoor temperature, and information on scores corresponding to the temperature difference.

The upper temperature limit is a temperature that is set as the upper limit of the indoor temperature during cooling operation in the second operation mode, which will be described separately below.

The lower temperature limit is a temperature that is set as the lower limit of the indoor temperature during heating operation in the second operation mode, which will be described separately below.

Note that the upper temperature limit corresponds to "second set temperature" according to the invention.

Note that the lower temperature limit corresponds to "third set temperature" according to the invention.

As illustrated in FIG. 3(*b*), exemplary scores according to Embodiment 1 are as follows. A difference between the upper temperature limit and the indoor temperature of plus 1.5 degrees C. to plus 3.0 degrees C. has a score of plus 1.

A difference between the upper temperature limit and the indoor temperature greater than or equal to plus 3.0 degrees C. has a score of plus 2.

A case where the indoor temperature is above a certain temperature (for example, 32.5 degrees C.) has a score of plus 4.

A difference between the lower temperature limit and the indoor temperature of minus 1.5 degrees C. to minus 3.0 degrees C. has a score of minus 1.

A difference between the lower temperature limit and the indoor temperature greater than or equal to minus 3.0 degrees C. has a score of minus 2.

A case where the indoor temperature is below a certain temperature (for example, 13.0 degrees C.) has a score of minus 4.

In the example illustrated in FIG. 3(*b*), although the case where the indoor temperature is above a certain temperature (for example, 32.5 degrees C.) has a score of plus 4, and the case where the indoor temperature is below a certain temperature (for example, 13.0 degrees C.) has a score of minus 4, the invention is not limited to such settings. The scores for the above cases may alternatively be defined in correspondence with the difference from the indoor temperature.

The plus scores each correspond to "score associated to cooling" according to the invention.

The minus scores each correspond to "score associated to heating" according to the invention.

The second score table 300 is also set with information on the operating state of the air-conditioning apparatus corresponding to the information on the temperature difference.

For example, within a range from a difference between the lower temperature limit and the indoor temperature of minus 1.5 degrees C. to a difference between the upper temperature limit and the indoor temperature of plus 1.5 degrees C., the mode is set to thermo-OFF.

If the difference between the lower temperature limit and the indoor temperature is greater than minus 1.5 degrees C. or if the difference between the upper temperature limit and the indoor temperature is greater than plus 1.5 degrees C., the mode is set to thermo-ON.

Although FIGS. 3(*a*) and 3(*b*) each illustrate a case where a certain score is defined to each range of temperature difference, the invention is not limited to such a case. Scores only need to correspond to the temperature difference. For example, a temperature difference of plus 1.5 degrees C. may have a score of plus 1.5. Thus, the value of the temperature difference may be directly employed as its score.

Further, although FIGS. 3(*a*) and (*b*) each illustrate a case where plus temperature differences have plus scores and minus temperature differences have minus scores, the invention is not limited to such a case.

For example, if the indoor temperature related to an air-conditioning apparatus that is in the first operation mode is above the set target temperature, a score corresponding to the difference between the indoor temperature and the set target temperature is given as a score associated to cooling. Furthermore, if the indoor temperature related to an air-conditioning apparatus that is in the first operation mode is below the set target temperature, a score corresponding to the difference between the indoor temperature and the set target temperature is given as a score associated to heating.

On the other hand, for example, if the indoor temperature related to an air-conditioning apparatus that is in the second operation mode is above the upper temperature limit, a score corresponding to the difference between the indoor temperature and the upper temperature limit is given as a score associated to cooling. Furthermore, if the indoor temperature related to an air-conditioning apparatus that is in the second operation mode is below the lower temperature limit, a score corresponding to the difference between the indoor temperature and the lower temperature limit is given as a score associated to heating.

Now, the first operation mode and the second operation mode that can be executed by each of the air-conditioning apparatuses will be described.

(First Operation Mode)

The first operation mode is a control in which a set target temperature is set, and each air-conditioning apparatus is switched to thermo-ON or to thermo-OFF so that the indoor temperature of a space where the air-conditioning apparatus is provided becomes the set target temperature.

First, the user selects a group to be operated in the first operation mode through the input device 120 of the integrated controller 10.

Furthermore, the user inputs, through the input device 120 of the integrated controller 10, a set target temperature as a target value of the indoor temperature of the space where the selected group is provided.

The controller 110 of the integrated controller 10 calculates the difference between the indoor temperature acquired from the air-conditioning apparatus of the selected group and the set target temperature of the selected group.

Furthermore, the controller 110 refers to the first score table stored in the storage device 140 and acquires information on the range of temperature difference for thermo-ON and the range of temperature difference for thermo-OFF.

During cooling operation of the air-conditioning apparatus, if the indoor temperature exceeds the set target temperature and the temperature difference is that for thermo-ON, the controller 110 switches the air-conditioning apparatus of the group to thermo-ON. On the other hand, during cooling operation of the air-conditioning apparatus, if the indoor temperature is below the set target temperature, the controller 110 switches the air-conditioning apparatus of the group to thermo-OFF.

During heating operation of the air-conditioning apparatus, if the indoor temperature falls below the set target temperature and the temperature difference is that of thermo-ON, the controller 110 switches the air-conditioning apparatus of the group to thermo-ON. On the other hand, during heating operation of the air-conditioning apparatus, if the indoor temperature is above the set target temperature, the controller 110 switches the air-conditioning apparatus of the group to thermo-OFF.

Regardless of the difference between the indoor temperature and the set target temperature in the group, the switching between cooling operation and heating operation is performed such that all the plurality of air-conditioning apparatuses are switched to either one of heating operation and cooling operation through a process described separately below.

The first operation mode is a control that mainly improves comfort.

For example, an air-conditioning apparatus provided in a space where a person is present is set to the first operation mode and is controlled such that the indoor temperature become close to the set target temperature, regardless of whether in cooling operation or in heating operation.

(Second Operation Mode)

The second operation mode is a control in which an upper temperature limit and a lower temperature limit are set. In cooling operation, each air-conditioning apparatus is switched to thermo-ON or to thermo-OFF so that the indoor temperature of a space where the air-conditioning apparatus is provided becomes below the upper temperature limit. In heating operation, each air-conditioning apparatus is switched to thermo-ON or to thermo-OFF so that the indoor temperature of a space where the air-conditioning apparatus is provided becomes above the lower temperature limit.

First, the user selects a group to be operated in the second operation mode through the input device 120 of the integrated controller 10.

Furthermore, the user inputs, through the input device 120 of the integrated controller 10, an upper temperature limit and a lower temperature limit of the indoor temperature of the space where the selected group is provided.

The controller 110 of the integrated controller 10 calculates the difference between the indoor temperature acquired from the air-conditioning apparatus of the selected group and the upper temperature limit or lower temperature limit.

Furthermore, the controller 110 refers to the second score table stored in the storage device 140 and acquires information on the range of temperature difference for thermo-ON and the range of temperature difference for thermo-OFF.

During cooling operation of the air-conditioning apparatus, if the indoor temperature exceeds the upper temperature limit and the temperature difference is that for thermo-ON, the controller 110 switches the air-conditioning apparatus of the group to thermo-ON. On the other hand, during cooling operation of the air-conditioning apparatus, if the indoor temperature is below the upper temperature limit, the controller 110 switches the air-conditioning apparatus of the group to thermo-OFF.

During heating operation of the air-conditioning apparatus, if the indoor temperature falls below the lower temperature limit and the temperature difference is that of thermo-ON, the controller 110 switches the air-conditioning apparatus of the group to thermo-ON. On the other hand, during heating operation of the air-conditioning apparatus, if the indoor temperature is above the set target temperature, the controller 110 switches the air-conditioning apparatus of the group to thermo-OFF.

Regardless of the difference between the indoor temperature and the upper temperature limit or lower temperature limit of the group, the switching between cooling operation and heating operation is performed such that all the plurality of air-conditioning apparatuses are switched to either one of heating operation and cooling operation through a process described separately below.

The second operation mode is a control that mainly improves energy saving.

That is, if the indoor temperature is between the upper temperature limit and the lower temperature limit, the mode is set to thermo-OFF. Therefore, the time period of thermo-OFF of the air-conditioning apparatuses can be increased compared to that of the first operation mode. Consequently, energy saving is improved.

For example, the second operation mode is used in a case where no one is present in a room and comfort is not desired but the air-conditioning apparatus is needed to be operated so that the indoor temperature is within a temperature range between an upper limit and a lower limit due to the existence of foliage plants, furniture, paintings, and so forth.

Although Embodiment 1 describes a case where the controller 110 of the integrated controller 10 executes the first operation mode and the second operation mode, the invention is not limited to such a case. Each of the individual air-conditioning apparatuses may alternatively execute the first operation mode and the second operation mode.

For example, information on the operation mode and information on the set target temperature or the upper temperature limit and lower temperature limit may be transmitted to the indoor units 30, and controlling means, such as microprocessors, included in the indoor units 30 may execute switching to thermo-ON or -OFF on the basis of the indoor temperatures and the set temperatures.

Alternatively, for example, a remote controller may be provided for each of the air-conditioning apparatuses or each of the groups, and the above-described process may be performed by setting an operation mode, a set target temperature, and so forth to the remote controller.

(Cooling/Heating Switching Operation)

A process of switching all the plurality of air-conditioning apparatuses to either one of heating operation and cooling operation will now be described.

Figure 4:
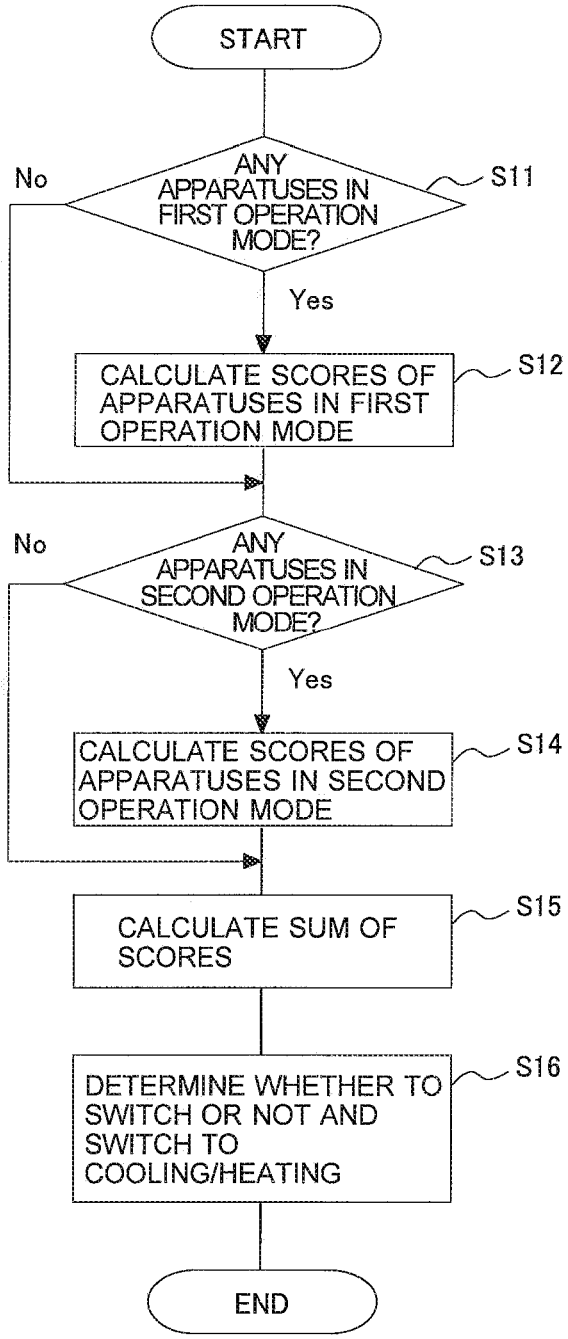
FIG. 4 is a flowchart of a cooling/heating switching operation according to Embodiment 1.

FIG. 4 is a flowchart of a cooling/heating switching operation according to Embodiment 1.

Figure 5:
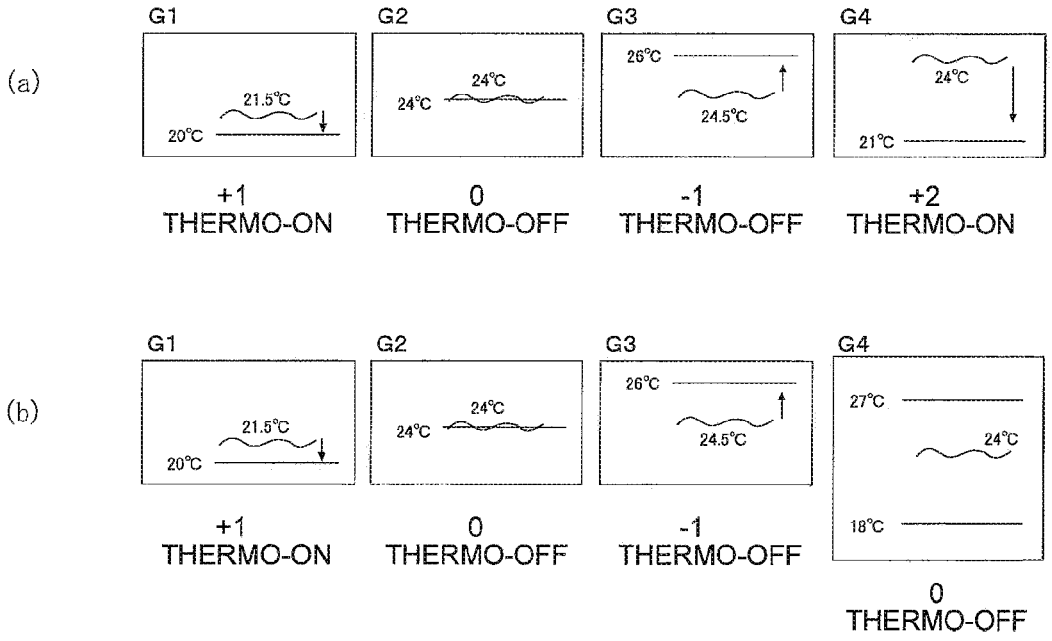
FIG. 5 includes diagrams illustrating exemplary operating states of air-conditioning apparatuses according to Embodiment 1.
Figure 6:
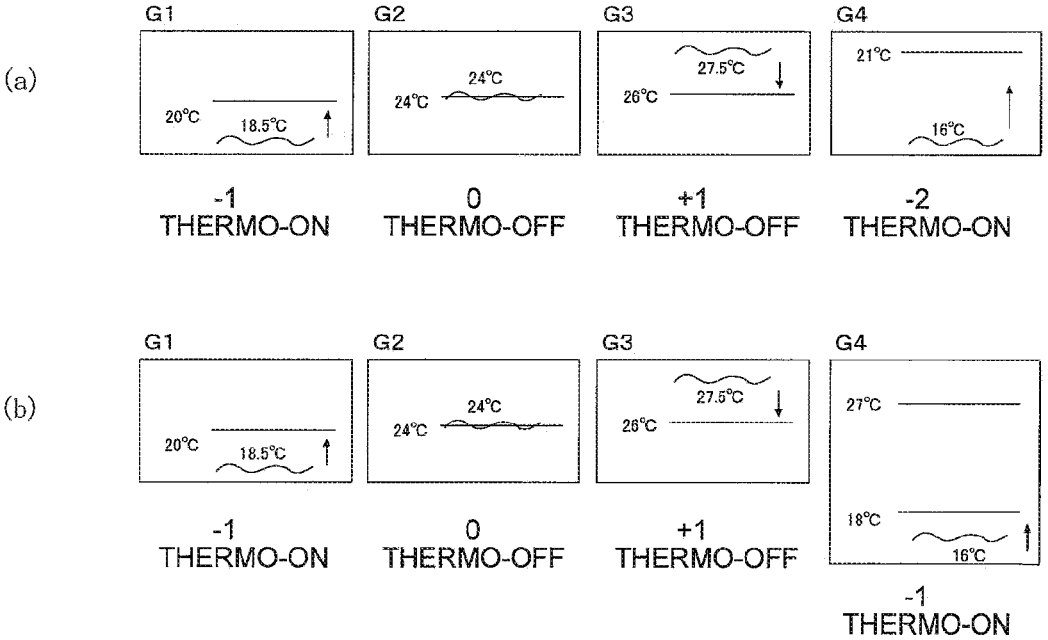
FIG. 6 includes diagrams illustrating exemplary operating states of air-conditioning apparatuses according to Embodiment 1.

FIGS. 5 and 6 each include diagrams illustrating exemplary operating states of the air-conditioning apparatuses according to Embodiment 1.

FIGS. 5(*a*) and 6(*a*) illustrate cases where groups G1 to G4 are all in the first operation mode.

FIGS. 5(*b*) and 6(*b*) illustrate cases where groups G1 to G3 are in the first operation mode and group G4 is in the second operation mode.

Description will be given following the steps illustrated in FIG. 4 and referring to FIGS. 3, 5, and 6.

(S11)

The controller 110 of the integrated controller 10 constantly or regularly (for example, at intervals of 15 minutes) performs a cooling/heating switching determination.

The controller 110 determines whether there is a group of air-conditioning apparatus that is in the first operation mode.

If there is no group that is in the first operation mode, the process proceeds to step S13.

(S12)

If there is a group that is in the first operation mode, the controller 110 gives a score based on the first score table 200 to the group (air-conditioning apparatus) that is in the first operation mode.

If the indoor temperature related to the group (air-conditioning apparatus) that is in the first operation mode is above its set target temperature, the controller 110 gives a score corresponding to the difference between the indoor temperature and its set target temperature as a score associated to cooling (plus score).

If the indoor temperature related to the air-conditioning apparatus that is in the first operation mode is below its set target temperature, the controller 110 gives a score corresponding to the difference between the indoor temperature and the set target temperature as a score associated to heating (minus score).

This will be described more specifically referring to the examples illustrated in FIGS. 5 and 6.

Take the example illustrated in FIG. 5(*a*). In group G1, the set target temperature is 20 degrees C., and the current indoor temperature is 21.5 degrees C.

In this case, the controller 110 subtracts the set target temperature from the current indoor temperature and thus obtains a temperature difference of plus 1.5 degrees C.

Then, the controller 110 refers to the first score table 200 illustrated in FIG. 3(*a*) and gives a score of plus 1, which corresponds to the temperature difference of plus 1.5 degrees C.

In the same manner, the controller 110 gives a score of 0 to group G2, a score of minus 1 to group G3, and a score of plus 2 to group G4.

Take the example illustrated in FIG. 5(*b*). Groups G1 to G3 are in the first operation mode. Therefore, the controller 110 gives a score of plus 1 to group G1, a score of 0 to group G2, and a score of minus 1 to group G3 in the same manner as that described above.

Take the example illustrated in FIG. 6(*a*). In group G1, the set target temperature is 20 degrees C., and the current indoor temperature is 18.5 degrees C.

In this case, the controller 110 subtracts the set target temperature from the current indoor temperature and thus obtains a temperature difference of minus 1.5 degrees C.

Then, the controller 110 refers to the first score table 200 illustrated in FIG. 3(*a*) and gives a score of minus 1, which corresponds to the temperature difference of minus 1.5 degrees C.

In the same manner, the controller 110 gives a score of 0 to group G2, a score of plus 1 to group G3, and a score of minus 2 to group G4.

Take the example illustrated in FIG. 6(*b*). Groups G1 to G3 are in the first operation mode. Therefore, the controller 110 gives a score of minus 1 to group G1, a score of 0 to group G2, and a score of plus 1 to group G3 in the same manner as that described above.

(S13)

Subsequently, the controller 110 determines whether there is a group of air-conditioning apparatus that is in the second operation mode.

If there is no group that is in the second operation mode, the process proceeds to step S15.

(S14)

If there is a group that is in the second operation mode and if the indoor temperature of the group (air-conditioning apparatus) that is in the second operation mode is above its upper temperature limit, the controller 110 gives a score corresponding to the difference between the indoor temperature and the upper temperature limit as a score associated to cooling.

If the indoor temperature related to the group (air-conditioning apparatus) that is in the second operation mode is below its lower temperature limit, the controller 110 gives a score corresponding to the difference between the indoor temperature and the lower temperature limit as a score associated to heating.

This will be described more specifically referring to the examples illustrated in FIGS. 5 and 6.

Take the examples illustrated in FIGS. 5(*a*) and 6(*b*). Since there are no groups that are in the second operation mode, step S14 is not performed.

Take the example illustrated in FIG. 5(*b*). In group G4 that is in the second operation mode, the upper temperature limit is 27 degrees C., the lower temperature limit is 18 degrees C., and the current indoor temperature is 24 degrees C. That is, the current set temperature is between the upper temperature limit and the lower temperature limit.

In this case, the controller 110 refers to the second score table 300 illustrated in FIG. 3(*b*) and gives a score of 0, which corresponds to the temperature between the upper temperature limit and the lower temperature limit.

Take the example illustrated in FIG. 6(*b*). In group G4 that is in the second operation mode, the upper temperature limit is 27 degrees C., the lower temperature limit is 18 degrees C., and the current indoor temperature is 16 degrees C.

In this case, the controller 110 subtracts the lower temperature limit from the current indoor temperature and thus obtains a temperature difference of minus 2.0 degrees C.

Then, the controller 110 refers to the second score table 300 illustrated in FIG. 3(*b*) and gives a score of minus 1, which corresponds to the temperature difference of minus 2.0 degrees C.

(S15)

The controller 110 calculates the sum of the scores given to each group in steps S12 and S14.

In the example illustrated in FIG. 5(*a*), the sum is plus 2.

In the example illustrated in FIG. 5(*b*), the sum is 0.

In the example illustrated in FIG. 6(*a*), the sum is minus 2.

In the example illustrated in FIG. 6(*b*), the sum is minus 1.

(S16)

If the sum calculated in step S15 is a plus value, the controller 110 switches all the plurality of air-conditioning apparatuses to cooling operation.

If the sum calculated in step S15 is a minus value, the controller 110 switches all the plurality of air-conditioning apparatuses to heating operation.

If the sum calculated in step S15 is 0, the cooling/heating switching operation is not performed and the current state is maintained.

That is, if the sum of the scores associated to heating is greater than the sum of the scores associated to cooling, all the plurality of air-conditioning apparatuses are switched to heating operation. On the other hand, if the sum of the scores associated to heating is less than the sum of the scores associated to cooling, all the plurality of air-conditioning apparatuses are switched to cooling operation.

In the example illustrated in FIG. 5(*a*), the sum is a plus value and all the plurality of air-conditioning apparatuses are switched to cooling operation.

Furthermore, the controller 110 calculates the temperature difference from the set target temperature of each group and switches the air-conditioning apparatus to thermo-ON or to thermo-OFF with the above operation of the first operation mode.

For example, in group G1, the temperature difference is plus 1.5 degrees C. Therefore, the air-conditioning apparatus of group G1 are set to thermo-ON.

Thus, the conditioned indoor space of group G1 is cooled so that its temperature becomes close to the set target temperature.

In the same manner, group G4 is set to thermo-ON and performs cooling operation. Group G2 and group G3 are set to thermo-OFF.

In the example illustrated in FIG. 5(*b*), the sum is 0. Therefore, the cooling/heating switching operation is not performed and the current state is maintained.

For example, if the current state is of cooling operation, groups G1 to G3 that are in the first operation mode operate in the same manner as in the case illustrated in FIG. 5(*a*) while group G4 that is in the second operation mode is set to thermo-OFF.

Thus, groups that are in the first operation mode are controlled such that the indoor temperatures become close to the respective set target temperatures, thereby comfort can be improved. Meanwhile, in groups that are in the second operation mode, air-conditioning apparatuses are each set to thermo-OFF if the indoor temperature is between the upper temperature limit and the lower temperature limit, thereby energy saving can be improved.

In the example illustrated in FIG. 6(*a*), the sum is a minus value and all the plurality of air-conditioning apparatuses are switched to heating operation.

Furthermore, the controller 110 calculates the temperature difference from the set target temperature of each group and sets the air-conditioning apparatus to thermo-ON or to thermo-OFF with the above operation of the first operation mode.

For example, in group G1, the temperature difference is minus 1.5 degrees C. Therefore, the air-conditioning apparatus of group G1 are set to thermo-ON.

Thus, the conditioned indoor space of group G1 is heated so that its temperature becomes close to the set target temperature.

In the same manner, group G4 is set to thermo-ON and performs heating operation. Group G2 and group G3 are set to thermo-OFF.

In the example illustrated in FIG. 6(*b*), the sum is a minus value and all the plurality of air-conditioning apparatuses are switched to heating operation.

Groups G1 to G3 that are in the first operation mode operate in the same manner as in the example illustrated in FIG. 6(*a*). Thus, the conditioned indoor space of group G1 is heated so that its temperature becomes close to the set target temperature.

Meanwhile, group G4 that is in the second operation mode has a temperature difference of minus 2.0 degrees C. Therefore, the air-conditioning apparatuses of group G4 are set to thermo-ON. Thus, the conditioned indoor space of group G4 is heated so that its temperature is above the lower temperature limit.

As described above, it will be possible to control the groups that are in the second operation mode such that the indoor temperatures do not fall below the respective lower temperature limits but do not exceed the respective upper temperature limits.

FIG. 7 includes diagrams illustrating exemplary temperature changes in the first operation mode and the second operation mode, according to Embodiment 1.

FIG. 7(*a*) illustrates temperature changes in the first operation mode.

As illustrated in FIG. 7(*a*), when the temperature is high during a period such as daytime, each air-conditioning apparatus perform cooling operation with the execution of the first operation mode and the indoor temperature is controlled to become close to the set target temperature.

Subsequently, when the temperature drops during a period such as night time, the indoor temperature also drops. If the temperature difference related to each air-conditioning apparatus becomes large, the system as a whole is switched to heating operation.

The switching to heating operation raises each indoor temperature, and each indoor temperature is controlled to become close to its set target temperature again.

Subsequently, when the temperature rises during a period such as daytime, the indoor temperature also rises. If the temperature difference related to each air-conditioning apparatuses becomes large, the system as a whole is switched to cooling operation.

The switching to cooling operation lowers each indoor temperature, and each indoor temperature is controlled to become close to its set target temperature again.

Such a process is repeated.

FIG. 7(*b*) illustrates temperature changes in the second operation mode.

As illustrated in FIG. 7(*b*), when the system as a whole is in cooling operation and the second operation mode is performed, the indoor temperatures are controlled so as not to exceed the respective upper temperature limits.

Subsequently, when the temperature drops during a period such as night time, the indoor temperatures also drop. Accordingly, the air-conditioning apparatuses in the second operation mode are switched to thermo-OFF, thereby energy saving can be improved.

If the temperature differences related to the air-conditioning apparatuses become large, the system as a whole is switched to heating operation.

While the system as a whole is in heating operation, the indoor temperatures are controlled so as not to fall below the respective lower temperature limits.

Subsequently, when the temperature rises during a period such as daytime, the indoor temperatures also rise. Accordingly, the air-conditioning apparatuses in the second operation mode are switched to thermo-OFF, thereby energy saving can be improved.

If the temperature differences related to the air-conditioning apparatuses become large, the system as a whole is switched to cooling operation.

Such a process is repeated.

As described above, in Embodiment 1, each of the air-conditioning apparatuses are operable in the first operation mode and the second operation mode. Moreover, all the plurality of air-conditioning apparatuses are switched to either one of heating operation and cooling operation on the basis of the difference between the indoor temperature related to each air-conditioning apparatus that is in the first mode and its set target temperature and the difference between the indoor temperature related to each air-conditioning apparatus that is in the second operation mode and its upper temperature limit or lower temperature limit.

Therefore, in the air-conditioning system in which all the plurality of air-conditioning apparatuses are switched to either one of heating operation and cooling operation, the indoor temperatures related to at least one or some of the plurality of air-conditioning apparatuses can be controlled to be between the upper temperature limit and the lower temperature limit.

Furthermore, even if at least one or some of the plurality of air-conditioning apparatuses are in the second operation mode, the system as a whole can be switched to cooling operation or heating operation on the basis of the difference between the indoor temperature and its set temperature related to each air-conditioning apparatus.

Furthermore, while one or some of the plurality of air-conditioning apparatuses are operating in the first operation mode, remaining one or some can operate in the second operation mode. Thus, both comfort and energy saving can be improved.

Furthermore, if the indoor temperature related to an air-conditioning apparatus that is in the first operation mode is above its set target temperature, a score corresponding to the respective difference between the indoor temperature and the set target temperature is given as a score associated to cooling. If the indoor temperature related to an air-conditioning apparatus that is in the first operation mode is below its set target temperature, a score corresponding to the respective difference between the indoor temperature and the set target temperature is given as a score associated to heating. If the indoor temperature related to an air-conditioning apparatus that is in the second operation mode is above its upper temperature limit, a score corresponding to the respective difference between the indoor temperature and the upper temperature limit are given as a score associated to cooling. If the indoor temperature related to an air-conditioning apparatus that is in the second operation mode is below its lower temperature limit, a score corresponding to the respective difference between the indoor temperature and the lower temperature limit is given as a score associated to heating. Furthermore, if the sum of the scores associated to heating is greater than the sum of the scores associated to cooling, all the plurality of air-conditioning apparatuses are switched to heating operation. If the sum of the scores associated to heating is less than the sum of the scores associated to cooling, all the plurality of air-conditioning apparatuses are switched to cooling operation.

Therefore, even if air-conditioning apparatuses in the first operation mode and that in the second operation mode co-exists, the system as a whole can be switched to an appropriate one of cooling operation and heating operation on the basis of the difference between a temperature that is a control target of each of the operation modes and the indoor temperature.

Thus, both comfort and energy saving can be improved.

The first score table and the second score table are stored in the storage device 140.

Therefore, scores can be given to air-conditioning apparatuses that are in the first operation mode on the basis of the first score table, and scores can be given to air-conditioning-apparatuses that are in the second operation mode on the basis of the second score table. Accordingly, the system as a whole can be switched to an appropriate one of cooling operation and heating operation on the basis of the difference between a temperature that is a control target of each of the operation modes and the indoor temperature.

Thus, both comfort and energy saving can be improved.

Embodiment 1 describes a case where switching between cooling and heating is performed on the basis of the sum of scores, including plus scores and minus scores, given in correspondence with the differences from the set temperatures. The invention is not limited to such a case.

For example, instead of giving scores, the following operation may be performed.

If the indoor temperature related to an air-conditioning apparatus that is in the first operation mode is above its set target temperature, it is determined that the air-conditioning apparatus is required to perform cooling. If the indoor temperature related to an air-conditioning apparatus that is in the first operation mode is below its set target temperature, it is determined that the air-conditioning apparatus is required to perform heating.

If the indoor temperature related to an air-conditioning apparatus that is in the second operation mode is above its upper temperature limit, it is determined that the air-conditioning apparatus need to perform cooling. If the indoor temperature related to an air-conditioning apparatus that is in the second operation mode is below its lower temperature limit, it is determined that the air-conditioning apparatus is required to perform heating.

If there are more air-conditioning apparatuses that are required to perform heating than air-conditioning apparatuses that are required to perform cooling among the plurality of air-conditioning apparatuses, all the plurality of air-conditioning apparatuses are switched to heating operation.

If there are more air-conditioning apparatuses that are required to perform cooling than air-conditioning apparatuses that are required to perform heating among the plurality of air-conditioning apparatuses, all the plurality of air-conditioning apparatuses are switched to cooling operation.

In such an operation, the advantageous effects described above can also be accomplished.

Although Embodiment 1 concerns a case where one or more air-conditioning apparatuses form groups, and an operation mode is performed and a score is given to each of the groups, the invention is not limited to such a case. The operation mode may be alternatively selected from the first operation mode and the second operation mode for each of the plurality of air-conditioning apparatuses, and a score may be given to each of the plurality of air-conditioning apparatuses.

Although Embodiment 1 concerns a case where operations of the air-conditioning apparatuses are controlled binarily, that is, thermo-ON and thermo-OFF, the invention is not limited to such a case. For example, control may be alternatively preformed in which the air-conditioning capacity is changed in correspondence with the temperature difference.

While Embodiment 1 concerns the case where operations of the air-conditioning apparatuses are controlled binarily, that is, thermo-ON and thermo-OFF, the invention is not limited to such a case. Instead of switching to thermo-OFF, the operations of relevant air-conditioning apparatuses may be stopped. By stopping the operations of the air-conditioning apparatuses, energy saving can be further improved from the case of switching to thermo-OFF.

While Embodiment 1 concerns the case where operations of the air-conditioning apparatuses are controlled binarily, that is, thermo-ON and thermo-OFF, the invention is not limited to such a case. The air-conditioning apparatuses may alternatively be controlled binarily such as resuming and suspending of the air-conditioning apparatuses.

Although Embodiment 1 concerns a case where scores are given to the air-conditioning apparatuses on the basis of the information written in the first score table 200 and the second score table 300 that are pre-stored in the storage device 140, the invention is not limited to such a case.

For example, score information (information on scores associated to cooling and scores associated to heating) in the first score table 200 and the second score table 300 may be set through user's operation performed on the input device 120.

In that case, scores can be set arbitrarily in accordance with the environment where the air-conditioning system is installed, the user's usage status, or the like.

Thus, the system as a whole can be switched to an appropriate one of cooling operation and heating operation in accordance with the usage environment or the like.

Embodiment 2

Embodiment 1 described above concerns a case where the cooling/heating switching determination is made by giving scores to groups (air-conditioning apparatuses) on the basis of the information written in the first score table 200 and the second score table 300 stored in the storage device 140.

Embodiment 2 concerns a case where scores associated to cooling and scores associated to heating are weighted according to the air-conditioning capacities of each air-conditioning apparatuses.

The configuration of an air-conditioning system according to Embodiment 2 is the same as that described in Embodiment 1, and like elements are denoted by like reference numerals.

The operation of the first operation mode and the second operation mode performed by each groups (air-conditioning apparatuses) are also the same as those described in Embodiment 1.

Differences from the cooling/heating switching operation according to Embodiment 1 (FIG. 4) will be described below.

(S12)

If there is a group that is in the first operation mode, the controller 110 acquires a score of the group (air-conditioning apparatus) that is in the first operation mode from the first score table 200.

Then, the controller 110 weights the score according to the air-conditioning capacity of the group (air-conditioning apparatus).

For example, the proportion of the air-conditioning capacity of the group to the total air-conditioning capacity of all groups is calculated as "weight of air-conditioning capacity".

Then, the score is multiplied by "weight of air-conditioning capacity". The results are employed as the score of the group.

(S14)

If there is a group that is in the second operation mode and if the indoor temperature of the group (air-conditioning apparatus) that is in the second operation mode is above its upper temperature limit, the controller 110 acquires a score corresponding to the difference between the indoor temperature and its upper temperature limit as a score associated to cooling.

If the indoor temperature related to the group (air-conditioning apparatus) that is in the second operation mode is below the respective lower temperature limit, the controller 110 acquires a score corresponding to the difference between the indoor temperature and its lower temperature limit as a score associated to heating.

Then, the controller 110 weights the score by the air-conditioning capacity of the group (air-conditioning apparatus).

For example, the proportion of the air-conditioning capacity of the group to the total air-conditioning capacity of all groups is calculated as "weight of air-conditioning capacity".

Then, the score is multiplied by "weight of air-conditioning capacity". The result is employed as the score of the group.

The other steps are the same as those described in Embodiment 1 (FIG. 4).

As described above, in Embodiment 2, the score associated to cooling and the score associated to heating are weighted by the air-conditioning capacity of the air-conditioning apparatus.

Thus, the score given to a group having a larger air-conditioning capacity can be made larger relative to the score given to a group having a smaller air-conditioning capacity.

That is, the temperature differences related to a group having a larger air-conditioning capacity can have a greater influence on the cooling/heating switching determination.

Thus, the system as a whole can be switched to an appropriate one of cooling operation and heating operation.

Embodiment 3

Embodiment 3 concerns a case where the cooling/heating switching operation is performed such that the indoor temperatures related to air-conditioning apparatuses that are in the second operation mode are maintained to be within a predetermined range, regardless of the indoor temperatures related to air-conditioning apparatuses that are in the first operation mode.

The configuration of an air-conditioning system according to Embodiment 3 is the same as that described in Embodiment 1, and like elements are denoted by like reference numerals.

The operation of the first operation mode and the second operation mode performed by each group (air-conditioning apparatus) are also the same as those described in Embodiment 1.

Scores in the second score table 300 according to Embodiment 3 are defined as follows.

If the indoor temperature related to an air-conditioning apparatus that is in the second operation mode is above its upper temperature limit and the difference between the indoor temperature and its upper temperature limit is greater than a predetermined value, the controller 110 gives a score, as a score associated to cooling to the air-conditioning apparatus that is in the second operation mode, that is greater than or equal to a value obtained through multiplication of the largest one of the scores associated to heating that is to be given to an ai2r-conditioning apparatus in the first operation mode by the total number of air-conditioning apparatuses.

This will be described more specifically.

For example, suppose that there are ten air-conditioning apparatuses (or groups), of which nine are in the first operation mode and one is in the second operation mode.

The "largest one of the scores associated to heating that is to be given to an air-conditioning apparatus in the first operation mode" is minus 2, which is the largest one of the minus scores in the first score table 200.

The "score greater than or equal to a value obtained through multiplication by the total number of air-conditioning apparatuses" is minus 20 because there are ten air-conditioning apparatuses.

In this case, a score in the second score table 300 corresponding to a temperature difference from the upper temperature limit that is greater than the predetermined value (for example, plus 3.0 degrees C.) is set as a score associated to cooling of plus 20 or greater.

With such a setting, even if the indoor temperatures related to all air-conditioning apparatuses that are in the first operation mode are low and heating needs to be performed, the system as a whole can be switched to cooling operation as long as the indoor temperature related to the air-conditioning apparatus that is in the second operation mode is above its upper temperature limit by a value greater than the predetermined value.

If the indoor temperature related to an air-conditioning apparatus that is in the second operation mode is below its lower temperature limit and the difference between the indoor temperature and its lower temperature limit is greater than a predetermined value, the controller 110 gives a score, as a score associated to heating to the air-conditioning apparatus that is in the second operation mode, that is greater than or equal to a value obtained through multiplication of the largest one of the scores associated to cooling that is to be given to an air-conditioning apparatus in the first operation mode by the total number of air-conditioning apparatuses.

This will be described more specifically.

For example, suppose that there are ten air-conditioning apparatuses (or groups), of which nine are in the first operation mode and one is in the second operation mode.

The "largest one of the scores associated to cooling that is to be given to an air-conditioning apparatuses in the first operation mode" is plus 2, which is the largest one of the plus scores in the first score table 200.

The "score greater than or equal to a value obtained through multiplication by the total number of air-conditioning apparatuses" is plus 20 because there are ten air-conditioning apparatuses.

In this case, a score in the second score table 300 corresponding to a temperature difference from the lower temperature limit that is greater than the predetermined value (for example, minus 3.0 degrees C.) is set as a score associated to heating of minus 20 or greater.

With such a setting, even if the indoor temperatures related to all air-conditioning apparatuses that are in the first operation mode are high and cooling needs to be performed, the system as a whole can be switched to heating operation as long as the indoor temperature related to the air-conditioning apparatus that is in the second operation mode is below its lower temperature limit by a value greater than the predetermined value.

As described above, in Embodiment 3, the system can be switched to either one of cooling operation and heating operation such that the indoor temperature related to an air-conditioning apparatus that is in the second operation mode is maintained to be within a predetermined range, regardless of the indoor temperatures related to air-conditioning apparatuses that are in the first operation mode.

Although Embodiment 3 describes an operation of setting scores in a case where the difference from the upper temperature limit or lower temperature limit exceeds a predetermined value, the invention is not limited to such an operation.

For example, scores described above may be employed in a case where the indoor temperature exceeds a predetermined upper limit (a fixed value) or falls below a predetermined upper limit (a fixed value), regardless of the difference from the upper temperature limit or lower temperature limit.

While Embodiment 3 describes an operation of setting the information written in the second score table 300, the invention is not limited to such a process. The following process may be alternatively employed.

For example, if the indoor temperature related to an air-conditioning apparatus that is in the second operation mode is above its upper temperature limit and the difference between the indoor temperature and its upper temperature limit is greater than a predetermined value, the controller 110 may switch all the plurality of air-conditioning apparatuses to cooling operation.

On the other hand, if the indoor temperature related to an air-conditioning apparatus that is in the second operation mode is below its lower temperature limit and the difference between the indoor temperature and its lower temperature limit is greater than a predetermined value, the controller 110 switches all the plurality of air-conditioning apparatuses to heating operation.

By such an operation, even if the indoor temperatures related to all air-conditioning apparatuses that are in the first operation mode are high and cooling needs to be performed, the system as a whole can be switched to heating operation as long as the indoor temperature related to the air-conditioning apparatus that is in the second operation mode is below its lower temperature limit by a value greater than the predetermined value.

REFERENCE SIGNS LIST

10 integrated controller; 20 outdoor unit; 30 indoor unit; 100 controller; 110 controller; 120 input device; 130 display device; 140 storage device; 150 communication device; 200 score table; 300 score table.

The invention claimed is:

1. An air-conditioning system, comprising:

a plurality of air-conditioning apparatuses; and a controller that switches all the air-conditioning apparatuses to either one of heating operation and cooling operation, wherein each air-conditioning apparatus is operable in a first operation mode that sets a first set indoor temperature and that controls a corresponding air-conditioning apparatus such that an indoor temperature of a space where the corresponding air-conditioning apparatus is provided becomes the first set indoor temperature, and a second operation mode that sets a second set indoor temperature and a third set indoor temperature, which is lower than the second set indoor temperature, and that controls a corresponding air-conditioning apparatus such that, during the cooling operation, an indoor temperature of a space where the corresponding air-conditioning apparatus is provided is controlled to become below the second set indoor temperature, and during the heating operation, the indoor temperature of the space where the corresponding air-conditioning apparatus is provided is controlled to become above the third set indoor temperature, and the controller switches all of the plurality of air-conditioning apparatuses to the heating operation or all of the plurality of air-conditioning apparatuses to the cooling operation on the basis of a temperature difference between the indoor temperature related to each air-conditioning apparatus of the plurality of air-conditioning apparatuses that is in the first operation mode and the first set indoor temperature, and a temperature difference between the indoor temperature related to each air-conditioning apparatus of the plurality of air-conditioning apparatuses that is in the second operation mode and the second set indoor temperature or the third set indoor temperature.

2. The air-conditioning system of claim 1, wherein if the indoor temperature related to each air-conditioning apparatus that is in the first operation mode is above the first set indoor temperature, the controller determines that the air-conditioning apparatus is required to perform cooling, if the indoor temperature related to each air-conditioning apparatus that is in the first operation mode is below the first set indoor temperature, the controller determines that the air-conditioning apparatus is required to perform heating, if the indoor temperature related to each air-conditioning apparatus that is in the second operation mode is above the second set indoor temperature, the controller determines that the air-conditioning apparatuses is required to perform cooling, if the indoor temperature related to each air-conditioning apparatus that is in the second operation mode is below the third set indoor temperature, the controller determines that the air-conditioning apparatus is required to perform heating, if there are more air-conditioning apparatuses that are required to perform heating than air-conditioning apparatuses that are required to perform cooling among the air-conditioning apparatuses, the controller switches all the air-conditioning apparatuses to the heating operation, and if there are more air-conditioning apparatuses that are required to perform cooling than air-conditioning apparatuses that are required to perform heating among the air-conditioning apparatuses, the controller switches all the air-conditioning apparatuses to the cooling operation.

3. The air-conditioning system of claim 1, wherein if the indoor temperature related to the air-conditioning apparatus that is in the first operation mode is above the first set indoor temperature, the controller gives a score, as a score associated to cooling, corresponding to the temperature difference between the indoor temperature and the first set indoor temperature, if the indoor temperature related to the air-conditioning apparatus that is in the first operation mode is below the first set indoor temperature, the controller gives a score, as a score associated to heating, corresponding to the temperature difference between the indoor temperature and the first set indoor temperature, if the indoor temperature related to the air-conditioning apparatus that is in the second operation mode is above the second set indoor temperature, the controller gives a score, as a score associated to cooling, corresponding to the difference between the indoor temperature and the second set indoor temperature, if the indoor temperature related to the of the air-conditioning apparatus that is in the second operation mode is below the third set indoor temperature, the controller gives a score, as a score associated to heating, corresponding to the difference between the indoor temperature and the third set indoor temperature, if a sum of the scores associated to heating is greater than a sum of the scores associated to cooling, the controller switches all the air-conditioning apparatuses to heating operation, and if the sum of the scores associated to heating is less than the sum of the scores associated to cooling, the controller switches all the air-conditioning apparatuses to cooling operation.

4. The air-conditioning system of claim 3, further comprising a storage device, the storage device stores a first data table being set with information on the temperature difference between the first set indoor temperature and the indoor temperature and information on the scores associated to cooling and the scores associated to heating, which corresponds to the temperature difference; and a second data table being set with information on the temperature difference between the second set indoor temperature and the indoor temperature and the temperature difference between the third set indoor temperature and the indoor temperature and information on the scores associated to cooling and the scores associated to heating, which corresponds to the temperature differences, the controller giving the score to each air-conditioning apparatus that is in the first operation mode on the basis of the first data table, and the controller giving the score to each air-conditioning apparatuses that is in the second operation mode on the basis of the second data table.

5. The air-conditioning system of claim 4, further comprising an input device, wherein the information on the scores associated to cooling and the scores associated to heating is set through an operation performed on the input device.

6. The air-conditioning system of claim 3, wherein the controller weights the score associated to cooling or the score associated to heating according to the air-conditioning capacity of the corresponding air-conditioning apparatus.

7. The air-conditioning system of claim 1, wherein if the indoor temperature related to the air-conditioning apparatus that is in the second operation mode is above the second set indoor temperature and the temperature difference between the indoor temperature and the second set indoor temperature is greater than a predetermined value, the controller switches all the air-conditioning apparatuses to the cooling operation, and if the indoor temperature related to the air-conditioning apparatus that is in the second operation mode is below the third set indoor temperature and the temperature difference between the indoor temperature and the third set indoor temperature is greater than a predetermined value, the controller switches all the air-conditioning apparatuses to the heating operation.

8. The air-conditioning system of claim 3, wherein if the indoor temperature related to the air-conditioning apparatus that is in the second operation mode is above the second set indoor temperature and the temperature difference between the indoor temperature and the second set indoor temperature is greater than a predetermined value, the controller gives a score, as a score associated to cooling to the air-conditioning apparatus that is in the second operation mode, that is greater than or equal to a value obtained through multiplication of a largest one of the scores associated to heating that are to be given to the air-conditioning apparatus in the first operation mode by the total number of air-conditioning apparatuses, and if the indoor temperature related to the air-conditioning apparatus that is in the second operation mode is below the third set indoor temperature and the temperature difference between the indoor temperature and the third set indoor temperature is greater than a predetermined value, the controller gives a score, as a score associated to heating to the air-conditioning apparatus that is in the second operation mode, that is greater than or equal to a value obtained through multiplication of a largest one of the scores associated to cooling that are to be given to the air-conditioning apparatus in the first operation mode by the total number of air-conditioning apparatuses.

9. The air-conditioning system of claim 3, wherein the air-conditioning apparatuses operate in the first operation mode or the second operation mode in units of groups each including one or more air-conditioning apparatuses, and the controller gives the score associated to cooling and the score associated to heating to each of the groups.

10. An air-conditioning system, comprising:

a plurality of air-conditioning apparatuses; and a controller that switches all the air-conditioning apparatuses to either one of heating operation and cooling operation, wherein each air-conditioning apparatus is operable in a first operation mode that sets a first set indoor temperature and that controls a corresponding air-conditioning apparatus such that an indoor temperature of a space where the corresponding air-conditioning apparatus is provided becomes the first set indoor temperature, and a second operation mode that sets a second set indoor temperature and a third set indoor temperature, which is lower than the second set indoor temperature, and that controls a corresponding air-conditioning apparatus such that, during the cooling operation, an indoor temperature of a space where the corresponding air-conditioning apparatus is provided becomes below the second set indoor temperature and, during the heating operation, the indoor temperature of the space where the corresponding air-conditioning apparatus is provided becomes above the third set indoor temperature; and the controller:

calculates a score of the first operation mode based on a temperature difference between the indoor temperature related to each air-conditioning apparatus of the plurality of air-conditioning apparatuses that is in the first operation mode and the first set indoor temperature, calculates a score of the second operation mode based on a temperature difference between the indoor temperature related to each air-conditioning apparatus of the plurality of air-conditioning apparatuses that is in the second operation mode and the second set indoor temperature or the third set indoor temperature, calculates sum of the score of the first operation mode and the score of the second operation mode, and switches all of the plurality of air-conditioning apparatuses to the heating operation or all of the plurality of air-conditioning apparatuses to the cooling operation on the basis of the sum of the scores.

* * * * *